US012078446B2

(12) United States Patent
Gann

(10) Patent No.: US 12,078,446 B2
(45) **Date of Patent: *Sep. 3, 2024**

(54) ARCHERY BOW WITH SLING MOUNT

(71) Applicant: MCP IP, LLC, Sparta, WI (US)

(72) Inventor: Brandon J. Gann, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/677,751

(22) Filed: Feb. 22, 2022

(65) Prior Publication Data

US 2022/0178647 A1 Jun. 9, 2022

Related U.S. Application Data

(63) Continuation of application No. 16/899,354, filed on Jun. 11, 2020, now Pat. No. 11,255,631.

(60) Provisional application No. 62/860,638, filed on Jun. 12, 2019.

(51) Int. Cl.
*F41B 5/10* (2006.01)
*F41B 5/14* (2006.01)

(52) U.S. Cl.
CPC ..... *F41B 5/1461* (2013.01); *F41B 5/10* (2013.01)

(58) Field of Classification Search
CPC ..... F41B 5/1461; F41B 5/10; F41B 5/063; A63C 11/025
USPC ..... 124/86; 224/257
See application file for complete search history.

(56) References Cited

U.S. PATENT DOCUMENTS

| | | | | |
|---|---|---|---|---|
| 3,055,354 | A | 9/1962 | Gates | |
| 3,204,626 | A | 9/1965 | Morneau | |
| 3,572,312 | A | 3/1971 | Foster | |
| 5,065,732 | A * | 11/1991 | Smith | F41B 5/1461 224/916 |
| 5,513,621 | A * | 5/1996 | Vanskiver | F41B 5/1457 224/916 |
| 5,730,341 | A * | 3/1998 | Hester, Jr. | F41B 5/1461 224/916 |
| 5,738,080 | A | 4/1998 | Brocco, Jr. | |
| 6,045,019 | A * | 4/2000 | Moses | A45F 5/1026 294/170 |
| D551,314 | S | 9/2007 | Primos | |
| 8,523,031 | B2 * | 9/2013 | Hedrick | A45F 5/00 224/257 |
| 9,146,073 | B1 * | 9/2015 | Roy | F41B 5/1461 |
| 9,581,406 | B1 * | 2/2017 | Nevels | F41B 5/0031 |
| 11,255,631 | B2 * | 2/2022 | Gann | F41B 5/1461 |
| 2008/0061094 | A1 * | 3/2008 | Dong | A45F 3/14 224/257 |
| 2012/0192843 | A1 * | 8/2012 | Batdorf | F41B 5/10 124/25.6 |
| 2013/0126568 | A1 * | 5/2013 | Arajakis | F41B 5/1461 224/257 |

(Continued)

*Primary Examiner* — John E Simms, Jr.
(74) *Attorney, Agent, or Firm* — Laabs Intellectual Property

(57) ABSTRACT

In some embodiments, an archery bow comprises a riser, a first limb, a second limb, a bowstring and a sling mount. In some embodiments, the sling mount comprises a proximal portion, an intermediate portion and a distal portion. In some embodiments, the proximal portion is attached to the bow. In some embodiments, a width of the intermediate portion is less than a width of the distal portion.

20 Claims, 9 Drawing Sheets

(56) References Cited

U.S. PATENT DOCUMENTS

| | | | | |
|---|---|---|---|---|
| 2015/0219417 | A1* | 8/2015 | Billings | F41B 5/1461 224/576 |
| 2016/0187096 | A1* | 6/2016 | Hamlin | F41B 5/1461 224/257 |
| 2018/0356185 | A1* | 12/2018 | Reeves | F41C 33/007 |

* cited by examiner

ARCHERY BOW WITH SLING MOUNT

CROSS-REFERENCE TO RELATED APPLICATIONS

This application claims the benefit of U.S. patent application Ser. No. 16/899,354, filed Jun. 11, 2020, which claims the benefit of U.S. Patent Application No. 62/860,638, filed Jun. 12, 2019, the entire content of each of which are hereby incorporated herein by reference.

BACKGROUND OF THE INVENTION

This invention relates to archery bows, which are known in the art and used to launch arrows.

Bows can be difficult to carry due to their shape and design. Although bows generally include a grip that is used during shooting, it is not convenient to carry the bow using the grip. Different types of backpacks, straps and slings exist to aid an archer in carrying the bow. The carrying devices that are the most comfortable and convenient to use tend to have corresponding drawbacks such as larger size, greater weight and/or reduced stowability when compared to other carrying devices.

Archers also use bow hoists or lifts to raise a bow to a tree stand. A small rope can be attached to the bow manually, for example by using a mechanical clip or carabiner that locks to the bow, or by tying the rope itself around a portion of the bow. Mechanical clips can produce noise and tying is inconvenient.

There remains a need for novel archery bow designs that are more convenient to use, carry and lift in the field.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser, a first limb cup supporting a first limb assembly and a second limb cup supporting a second limb assembly. In some embodiments, the first limb assembly comprises a first limb member and a second limb member. In some embodiments, the bow comprises a bowstring and a sling mount. In some embodiments, the sling mount comprises a proximal portion, an intermediate portion and a distal portion. In some embodiments, the proximal portion is attached to the first limb cup and a width of the intermediate portion is less than a width of the distal portion.

In some embodiments, a cord is engaged with the sling mount. In some embodiments, the cord extends between the first limb member and the second limb member. In some embodiments, the cord comprises a loop and a cord lock. In some embodiments, the loop is arranged to engage the sling mount. In some embodiments, the cord lock is moveable to adjust a size of the loop.

In some embodiments, the archery bow comprises a second sling mount. In some embodiments, the second sling mount is attached to the second limb cup.

In some embodiments, the bow comprises a sling engaged with the first sling mount and the second sling mount.

In some embodiments, the second limb assembly comprises a third limb member and a fourth limb member. In some embodiments, a sling extends between the first limb member and the second limb member and extends between the third limb member and the fourth limb member.

In some embodiments, a width of the intermediate portion is less than a width of the proximal portion. In some embodiments, the distal portion comprises a knob. In some embodiments, a width of the distal portion of the arm is less than a width of the knob. In some embodiments, the knob comprises a stem and a flange, the stem attached to the arm.

In some embodiments, an archery bow comprises a riser, a first limb, a second limb, a bowstring and a sling mount. In some embodiments, the sling mount comprises a proximal portion, an intermediate portion and a distal portion. In some embodiments, the proximal portion is attached to the bow. In some embodiments, a width of the intermediate portion is less than a width of the distal portion.

In some embodiments, the sling mount comprises an arm comprising the proximal portion, the intermediate portion and the distal portion. In some embodiments, the width of the intermediate portion is less than a width of the proximal portion. In some embodiments, the distal portion further comprises a knob. In some embodiments, a width of the distal portion of the arm being less than a width of the knob. In some embodiments, the knob comprises a stem and a flange, and the stem is attached to the arm.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
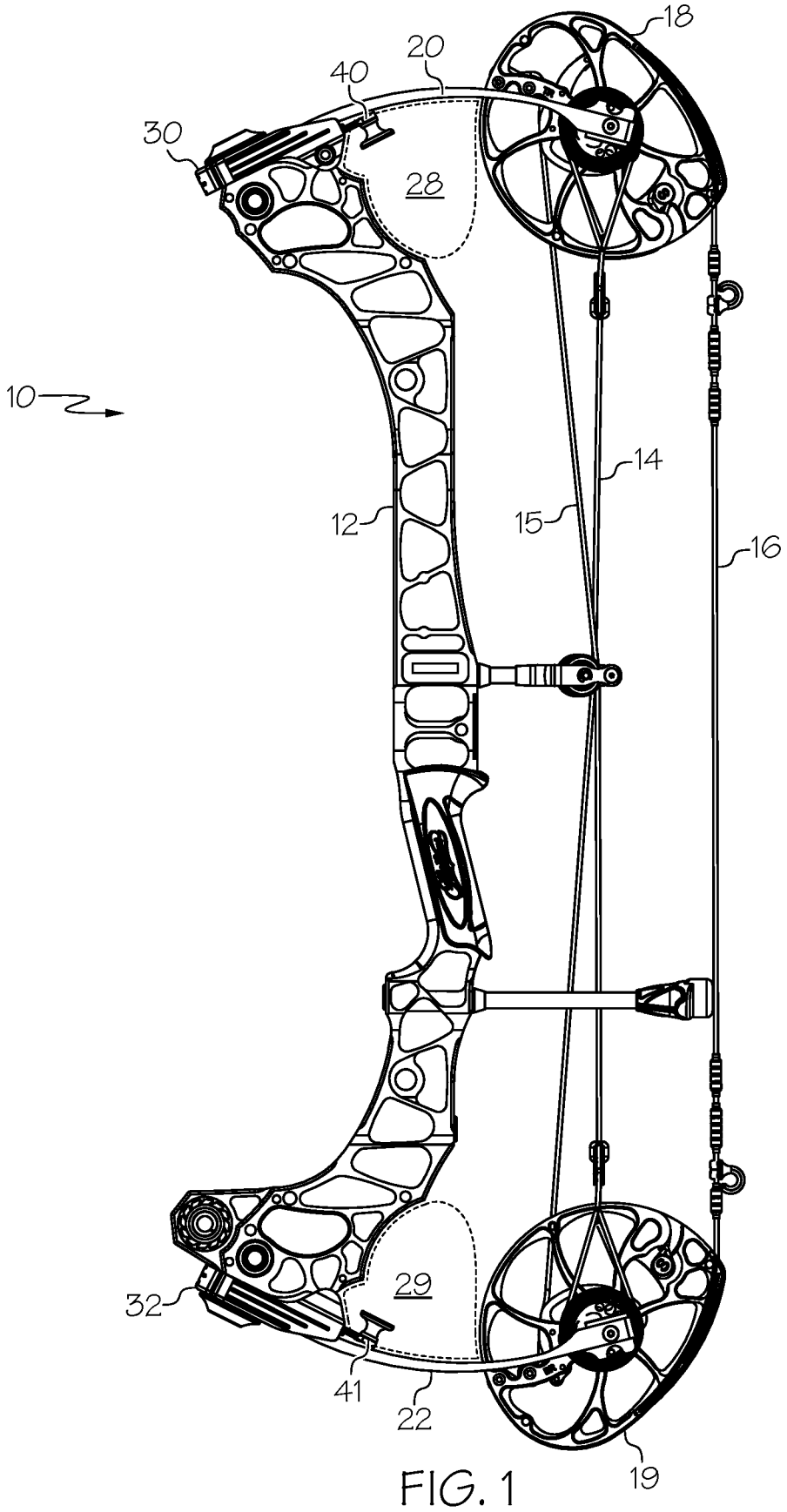
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 comprising a riser 12, a first limb 20, a second limb 22 and a bowstring 16. In some embodiments, the bow 10 comprises a first limb cup 30 and a second limb cup 32. In some embodiments, a limb cup 30, 32 is attached to the riser 12. In some embodiments, a limb cup 30, 32 supports a corresponding limb 20, 22. In some embodiments, a limb cup 30, 32 comprises features as disclosed in U.S. Pat. No. 8,453,635.

In some embodiments, the bow 10 comprises a compound bow comprising a first rotatable member 18 and a second rotatable member 19. In some embodiments, the bow 10 comprises a first power cable 14. In some embodiments, the bow 10 comprises a second power cable 15.

In some embodiments, the bow 10 comprises a sling mount 40. In some embodiments, the bow 10 comprises a second sling mount 41. In some embodiments, the second sling mount 41 is shaped similarly to the first sling mount 40. In some embodiments, the second sling mount 41 is shaped according to a mirror image of the first sling mount 41.

In some embodiments, the riser 12 and the first limb 20 define an area or space 28 that is substantially surrounded or bounded by the riser 12 and first limb 20. In some embodiments, the space 28 defines a substantially triangular shape, wherein the riser 12 defines a first side of the substantially triangular shape and the first limb 20 defines a second side of the substantially triangular shape. In some embodiments, the space 28 is adjacent to a concave surface of the first limb 20. In some embodiments, a sling mount 40 is oriented in the space 28. In some embodiments, the riser 12 and the second limb 22 define a second area or space 29 that is substantially surrounded or bounded by the riser 12 and second limb 20. In some embodiments, the second sling mount 41 is oriented in the second space 29.

Figure 6:
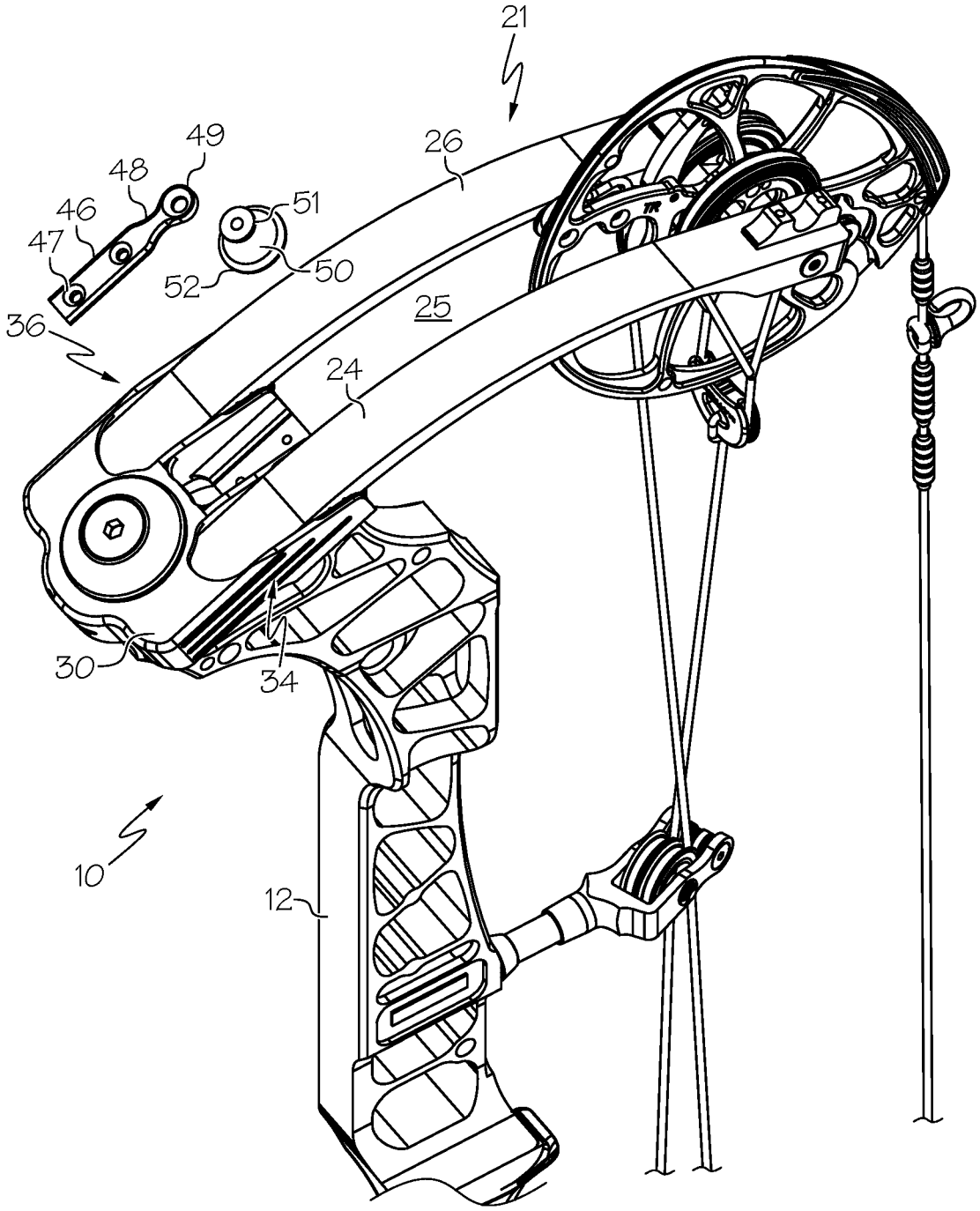
FIG. 6 shows a portion of an embodiment of a bow and an exploded view of an embodiment of a sling mount.

FIGS. 2-5 show portions of the bow 10 of FIG. 1 in greater detail. FIG. 6 shows an exploded view.

Figure 2:
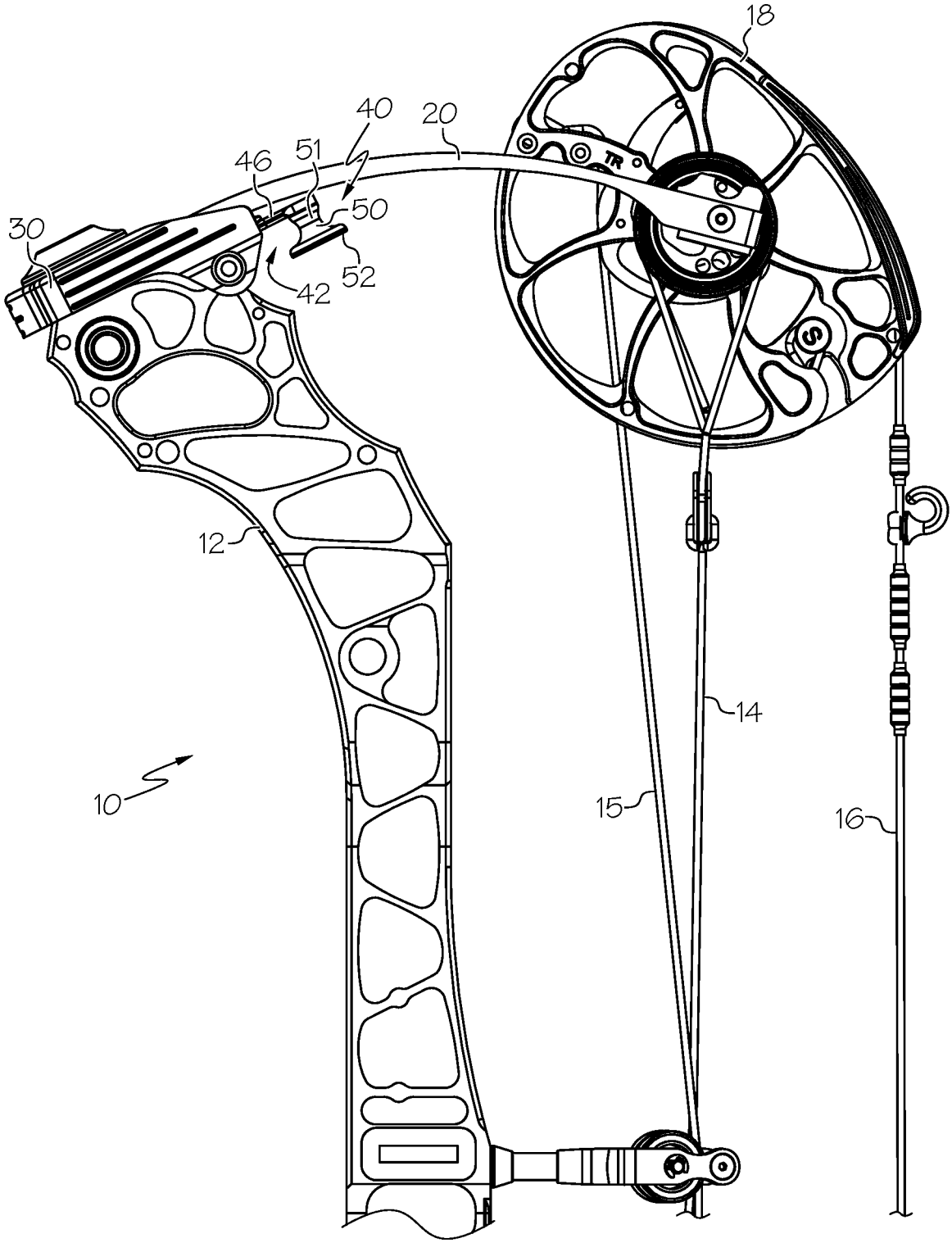
FIG. 2-4 each show a more detailed view of a portion of the bow shown in FIG. 1.
Figure 3:
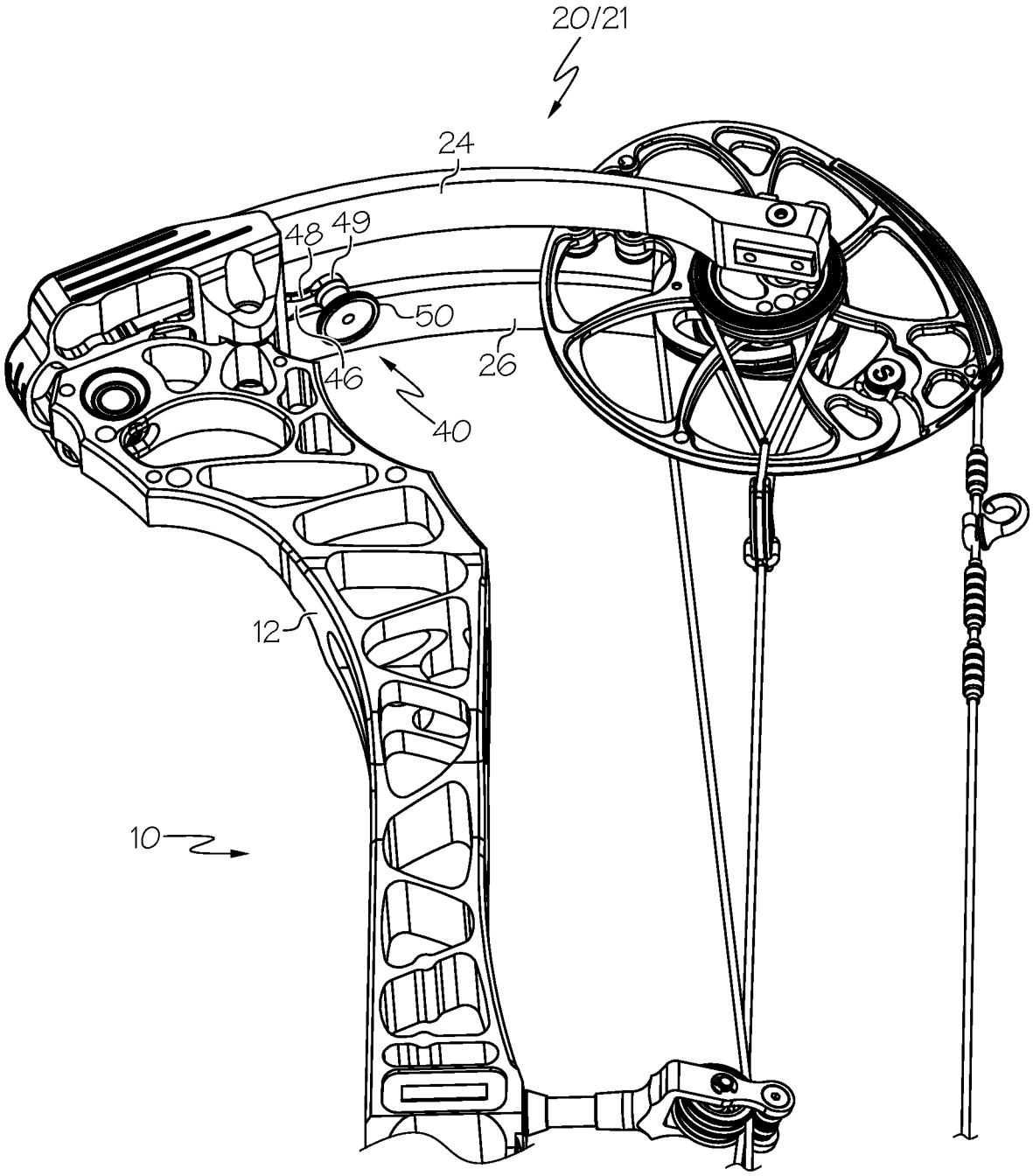
Figure 4:
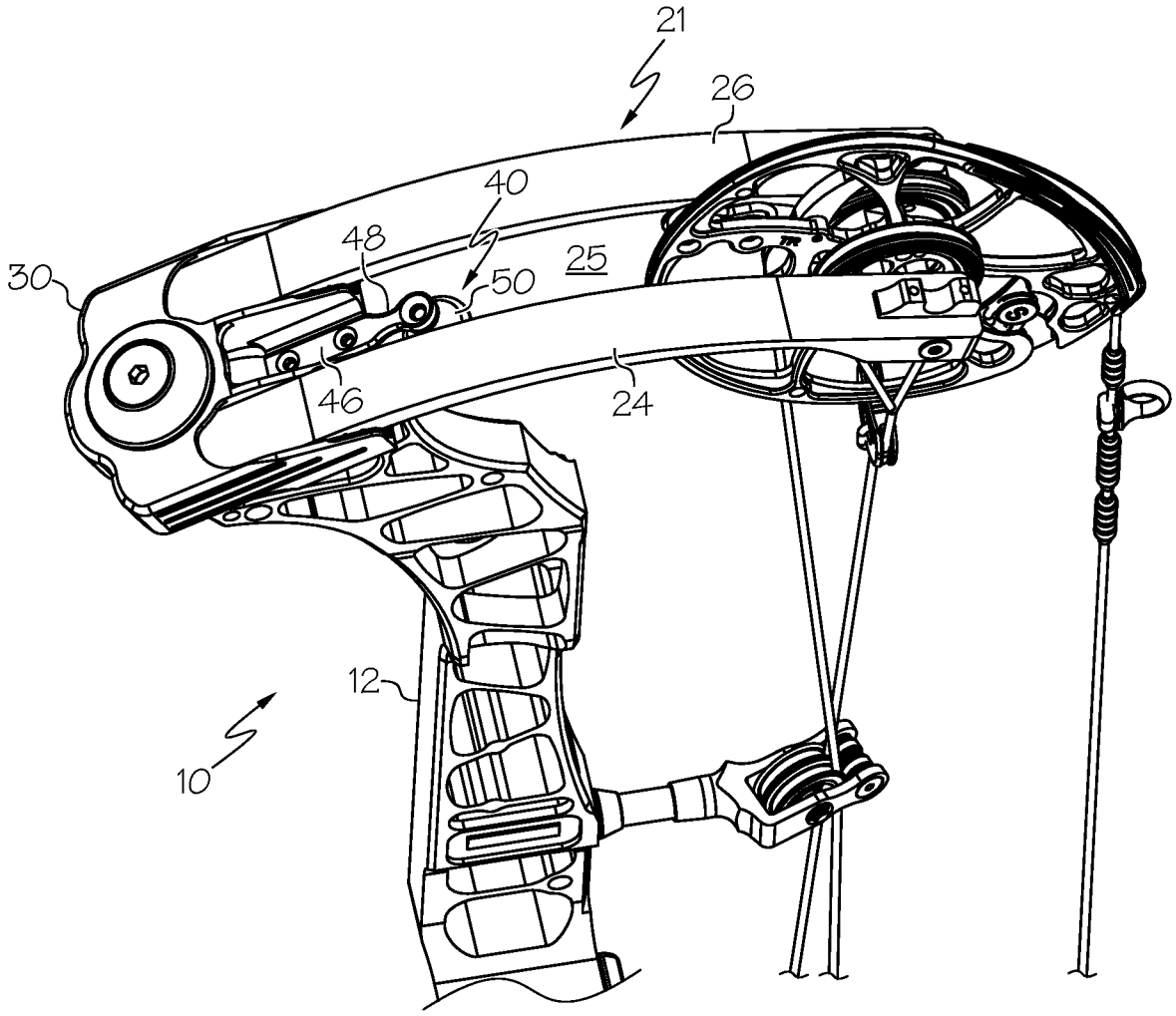
Figure 5:
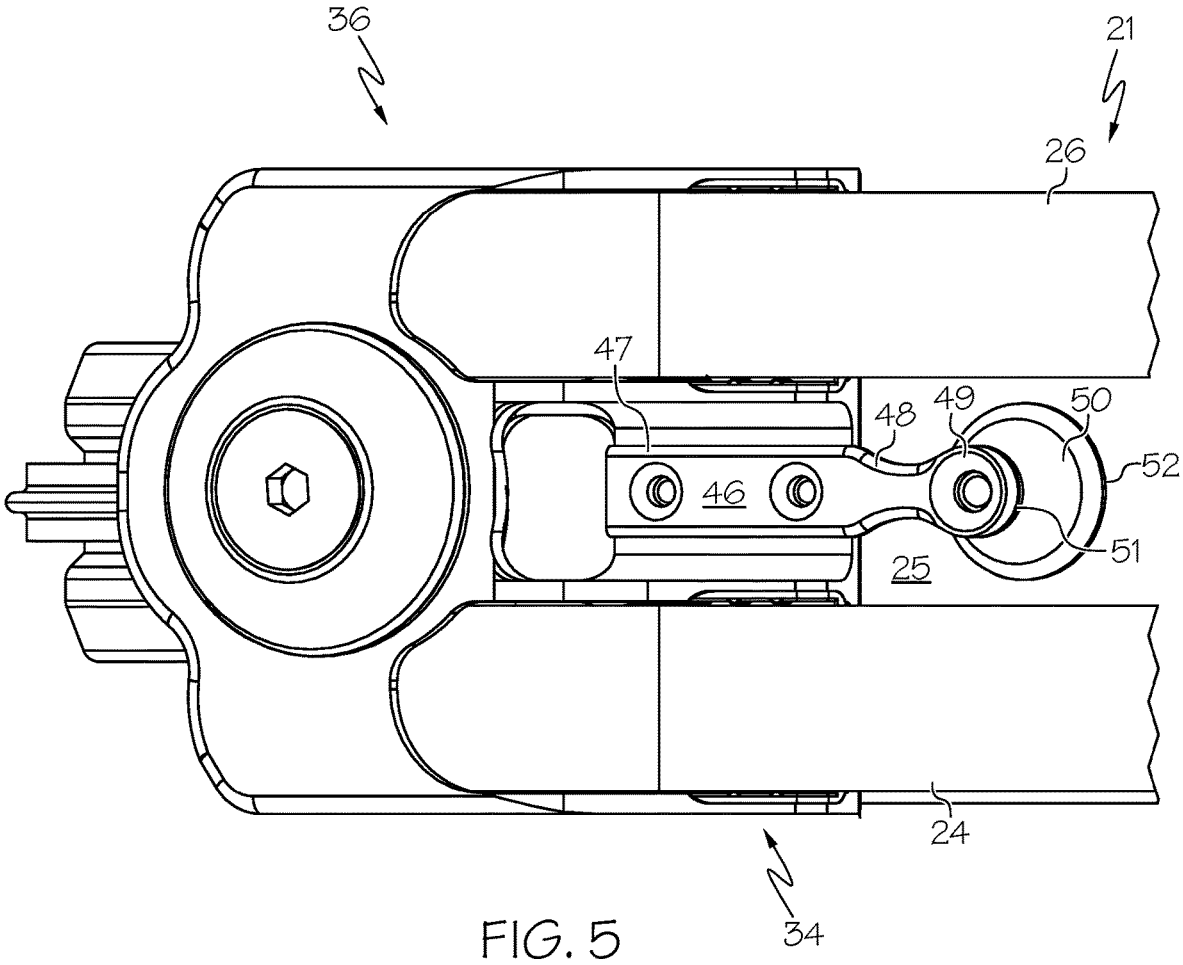
FIG. 5 shows a detailed view of an embodiment of a sling mount.

A sling mount 40 can be attached to any suitable portion of the bow 10. In some embodiments, a sling mount 40 is attached to the riser 12. As shown in FIGS. 2-4, in some embodiments, a sling mount 40 is attached to a limb cup 30.

In some embodiments, a sling mount 40 comprises an arm 46. In some embodiments, a sling mount 40 comprises a knob 50. In some embodiments, the arm 46 is supported by the limb cup 30. In some embodiments, the knob 50 is supported by the arm 46.

In some embodiments, the arm 46 comprises a first portion 47 and a second portion 49. In some embodiments, the first portion 47 is arranged for attachment to a bow 10, for example comprising apertures for fasteners. In some embodiments, the second portion 49 comprises an end of the arm 46. In some embodiments, the second portion 49 is arranged to support a knob 50, hook, terminal or any other suitable distal portion of the sling mount 40.

In some embodiments, the arm 46 comprises a neck portion 48. In some embodiments, the neck portion 48 comprises a narrowed portion of the arm 46. In some embodiments, a distance across the second portion 49 is greater than a distance across the neck portion 48. In some embodiments, the neck portion 48 provides a recessed area that can be used to orient a rope or sling.

In some embodiments, a knob 50 comprises a stem 51 and a flange 52. In some embodiments, the flange 52 is larger than the stem 51. In some embodiments, the flange 52 comprises an enlarged portion of the sling mount 40 that helps to prevent a rope or sling from detaching from a sling mount 40.

In some embodiments, the neck 48 of the arm 46 comprises a first width and the second portion 49 of the arm 46 comprises a second width, wherein the first width is less than the second width. In some embodiments, the stem 51 of the knob 50 comprises a third width, wherein the third width is less than or equal to the second width. In some embodiments, the flange 52 of the knob 50 comprises a fourth width, wherein the fourth width is greater than the third width. In some embodiments, the fourth width is greater than the second width. In some embodiments, the neck 48 comprises a smallest width defined by the sling mount 40. In some embodiments, the flange 52 comprises the largest width defined by the sling mount 40.

In some embodiments, the sling mount 40 comprises a hook 42. In some embodiments, the knob 50 comprises a portion of a hook 42. In some embodiments, a hook 42 is oriented to face the riser 12 and to face away from an adjacent limb 20. In some embodiments, a portion of a knob 50 comprises an end of the hook 42. In some embodiments, a portion of a flange 52 comprises an end of the hook 42. In some embodiments, the size of a hook 42 increases as the hook 42 is traversed toward its unsupported end. In some embodiments, a width of a hook 42 increases as the hook 42 is traversed toward its unsupported end. This can help prevent a rope or sling from detaching from a sling mount 40.

In some embodiments, a sling mount 40 comprises a cantilever body structure comprising a supported end and an unsupported end. In some embodiments, the cantilever body structure comprises a first, smaller dimension at a location closer to the supported end and a second, larger dimension at a location closer to the unsupported end.

In some embodiments, the sling mount(s) 40, 42 are aligned upon a central vertical axis of the bow 10. In some embodiments, a central vertical plane of the bow 10 intersects the sling mount(s) 40, 42. In some embodiments, a shooting axis of the bow 10 is contained within the central vertical plane of the bow 10.

In some embodiments, a first sling mount 40 is aligned with a second sling mount 42.

In some embodiments, a limb cup 30 supports a limb assembly 21, and the limb assembly 21 supports a rotatable member 18. In some embodiments, a limb assembly 21 comprises a first limb portion 24 and a second limb portion 26. In some embodiments, the first limb portion 24 and second limb portion 26 are separated by a gap 25. In some embodiments, a sling mount 40 is aligned with the gap 25.

In some embodiments, a limb cup 30 defines a first cavity 34 and a second cavity 36. In some embodiments, the first cavity 34 receives the first limb portion 24 and the second cavity 36 receives the second limb portion 26. In some embodiments, a sling mount 40 is positioned between the first cavity 34 and the second cavity 36. In some embodiments, a sling mount 40 is supported by a structural portion of the limb cup 30 that is located between the first cavity 34 and the second cavity 36.

Figure 7:
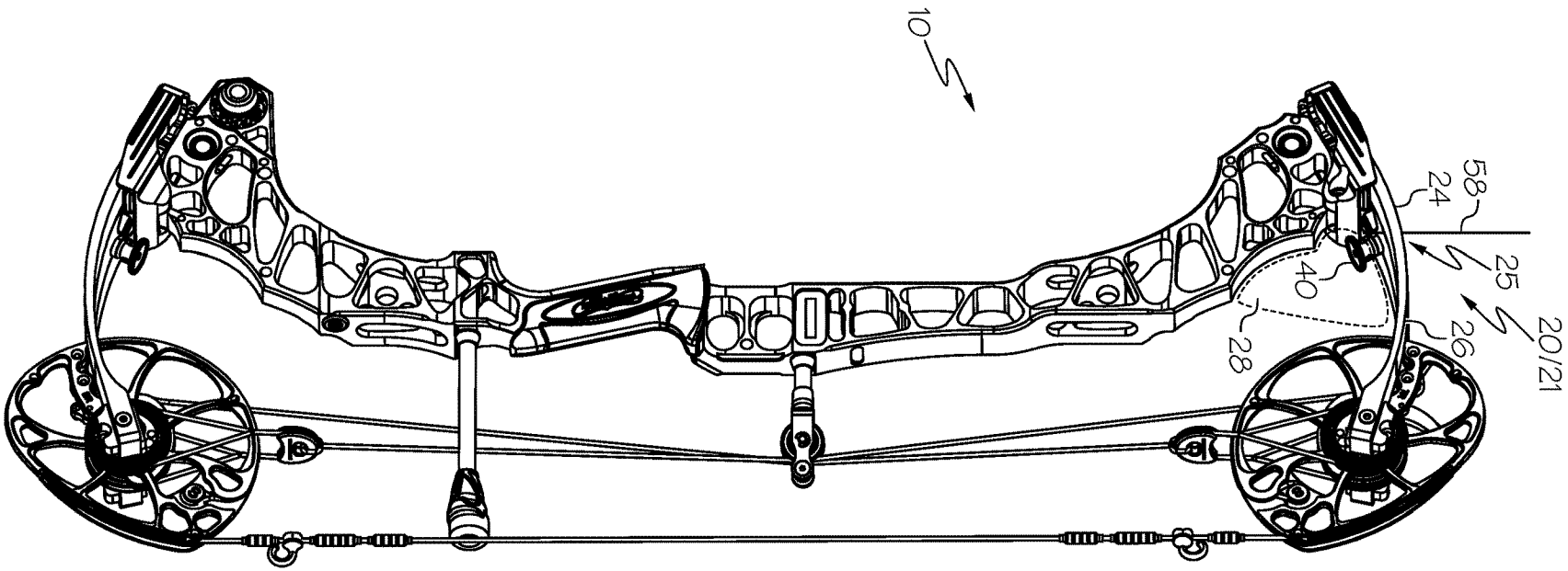
FIG. 7 shows an embodiment of a bow engaged with a lift cord.

FIG. 7 shows an embodiment of a bow 10 comprising a sling mount 40, with a cord 58 attached to the sling mount 40. In some embodiments, the cord 58 comprises a lift line that can be used to lift the bow 10, for example up into a tree stand, and to lower the bow 10.

In some embodiments, a cord 58 is attached to a sling mount 40 and extends between the first limb portion 24 and the second limb portion 26. In some embodiments, the cord 58 passes through a gap 25 defined between the first limb portion 24 and the second limb portion 26. In some embodiments, the cord 58 attaches to the sling mount 40 in an area 28 that is substantially bounded by the riser 12 and first limb/assembly 20/21, and the cord 58 extends outside of the area 28.

In some embodiments, the cord 58 is engaged with the neck 48 of a sling mount 40. In some embodiments, the neck 48 of a sling mount 40 is aligned with a centroid of the bow 10, which allows the bow 10 to be raised and lowered in a substantially vertical orientation as shown in FIG. 7.

Figure 8:
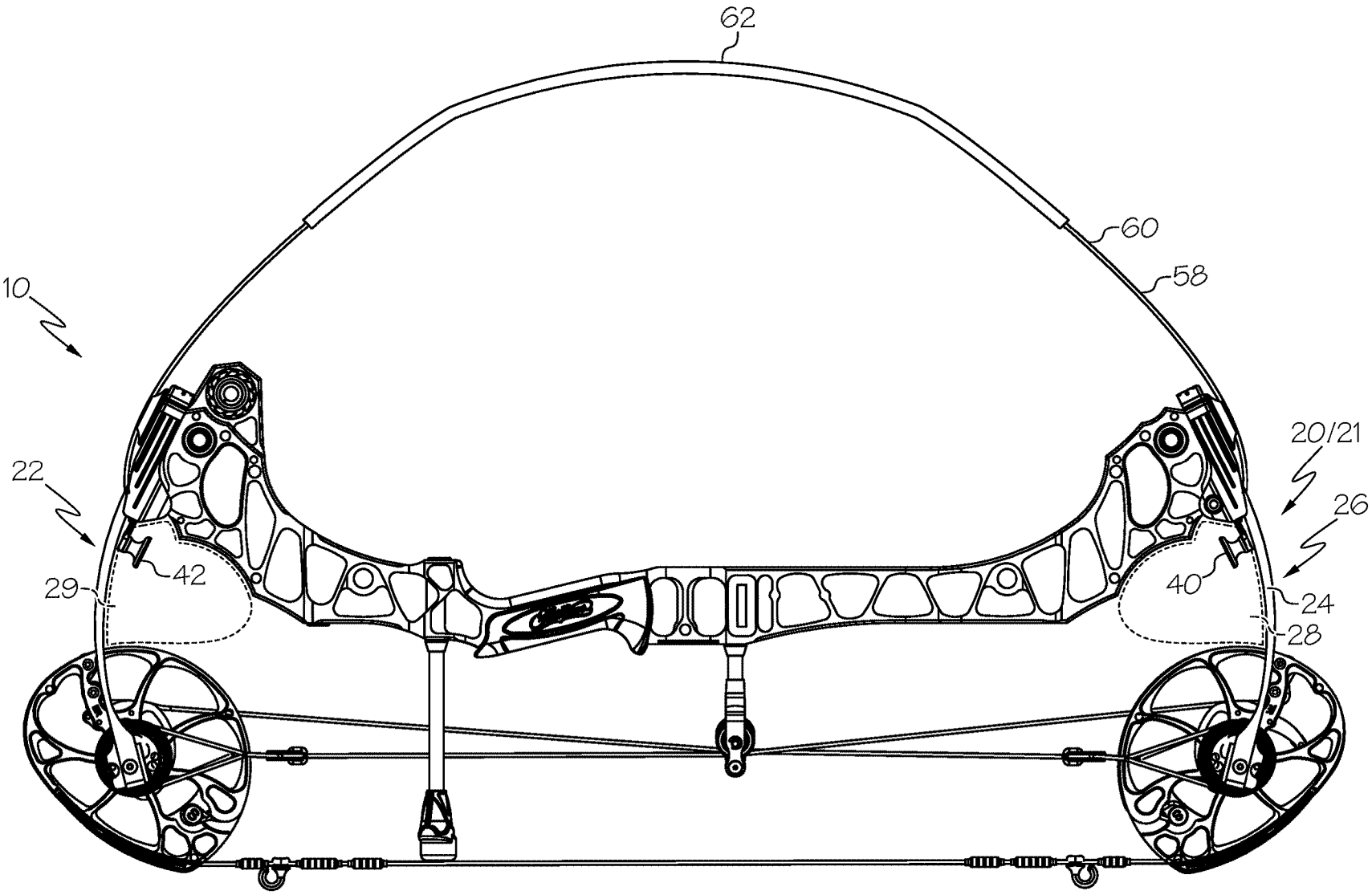
FIG. 8 shows an embodiment of a bow engaged with an embodiment of a sling.

FIG. 8 shows an embodiment of a bow 10 comprising a first sling mount 40 and a second sling mount 42, with a cord 58 attached at one end to the first sling mount 40 and attached at a second end to the second sling mount 42. In some embodiments, the cord 58 comprises a sling 60 and the bow 10 can be carried in the orientation shown in FIG. 8.

In some embodiments, the first end of a sling 60 is attached to a first sling mount 40 and extends between the first limb portion 24 and the second limb portion 26. In some embodiments, the sling 60 extends to the second limb 22 and a second end of the sling 60 extends between limb portions of the second limb/assembly 22 and attaches to the second sling mount 41. In some embodiments, the first end of the sling 60 attaches to the sling mount 40 in an area 28 that is substantially bounded by the riser 12 and first limb/assembly 20/21, and the sling 60 extends outside of the area 28. In some embodiments, a second end of the sling 60 extends into a second area 29 that is substantially bounded by the riser 12 and second limb/assembly 22 and attaches to a second sling mount 41 located within the second area 29.

Figure 9:
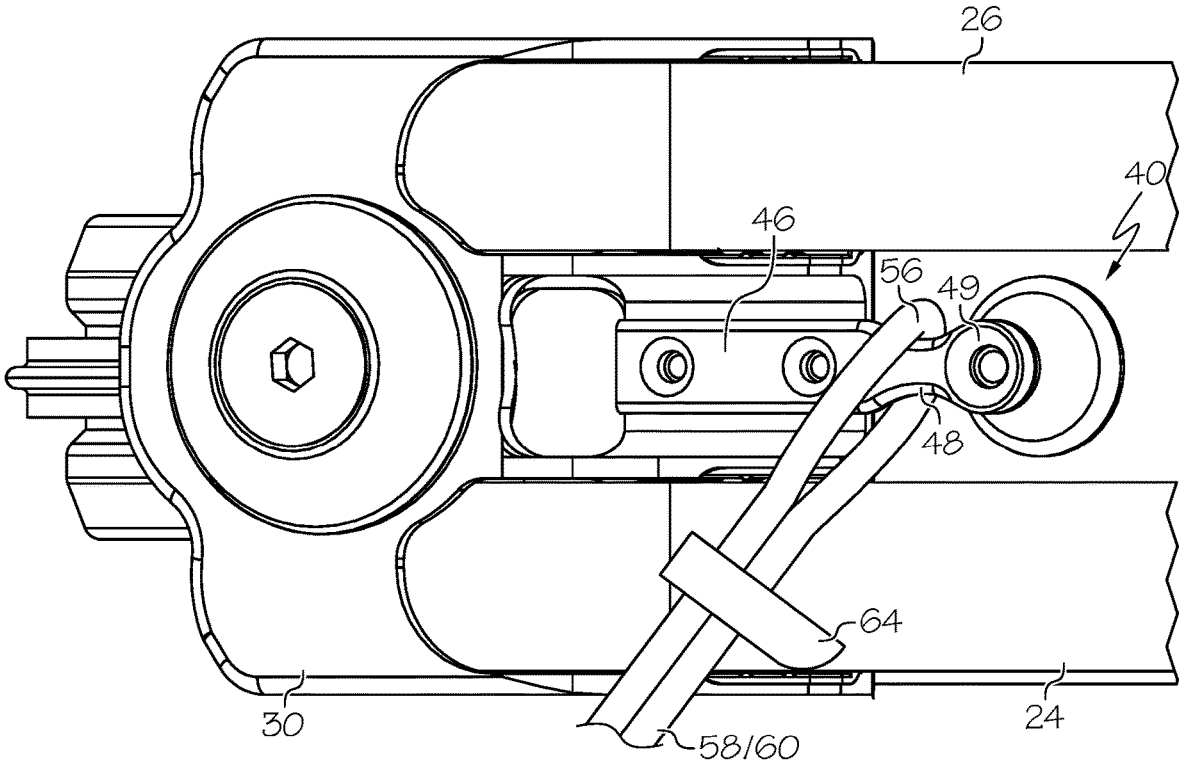
FIG. 9 shows an embodiment of a cord engaged with an embodiment of a sling mount.

FIG. 9 shows an embodiment of a cord 58 engaged with a sling mount 40. In some embodiments, a sling 60 comprises a cord 58. In some embodiments, a cord 58 comprises a rope or cable such as paracord. In some embodiments, a cord 58 comprises a braided portion 62. In some embodiments, a cord 58 comprises a loop 56. In some embodiments, the loop 56 can be engaged with the sling mount 40. In some embodiments, the loop 56 engages a neck portion 48 or narrowed portion of the sling mount 40. In some embodiments, a size of the loop 56 is adjustable. In some embodiments, the cord 58 comprises a cord lock 64. In some embodiments, a cord lock 64 is moveable along a length of the cord 58. In some embodiments, the cord lock 64 defines an end of the loop 56. In some embodiments, moving the cord lock 64 adjusts a size of the loop 56.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser;

a first limb cup supporting a first limb assembly, the first limb assembly comprising a first limb member and a second limb member;

a limb bolt attaching the first limb cup to the riser;

a second limb cup supporting a second limb assembly;

a bowstring; and a sling mount comprising a proximal portion, an intermediate portion and a distal portion, the proximal portion attached to the first limb cup, a width of the intermediate portion being less than a width of the distal portion;

wherein the limb bolt does not attach the sling mount to the archery bow.

2. The archery bow of claim 1, further comprising a cord engaged with the sling mount.

3. The archery bow of claim 2, the cord comprising a loop and a cord lock, the loop engaged with the sling mount, the cord lock moveable to adjust a size of the loop.

4. The archery bow of claim 1, the riser and the first limb assembly defining a surrounded space, the distal portion oriented in the surrounded space.

5. The archery bow of claim 1, the sling mount comprising a first sling mount, the bow comprising a second sling mount.

6. The archery bow of claim 5, the first sling mount and the second sling mount comprising the same shape.

7. The archery bow of claim 5, the second sling mount attached to the second limb cup.

8. The archery bow of claim 7, the second limb assembly comprising a third limb member and a fourth limb member, the bow comprising a sling engaged with the first sling mount, the sling extending between the first limb member and the second limb member, the sling extending between the third limb member and the fourth limb member, the sling engaged with the second sling mount.

9. The archery bow of claim 1, the sling mount comprising a knob.

10. The archery bow of claim 9, the width of the intermediate portion being less than a width of the proximal portion.

11. The archery bow of claim 10, the knob attached to the distal portion.

12. The archery bow of claim 11, a width of the distal portion being less than a width of the knob.

13. The archery bow of claim 12, the knob comprising a stem and a flange, the stem attached to the distal portion.

14. An archery bow comprising:

a riser;

a first limb;

a second limb;

a bowstring; and a sling mount comprising a proximal portion, an intermediate portion and a distal portion, the distal portion comprising a knob, the proximal portion attached to the bow, the intermediate portion and the distal portion extending away from the proximal portion, a width of the intermediate portion being less than a width of the distal portion;

the riser and the first limb defining a surrounded space, the knob oriented in the surrounded space.

15. The archery bow of claim 14, the width of the intermediate portion being less than a width of the proximal portion.

16. The archery bow of claim 14, the knob comprising a stem and a flange, the stem attached to the distal portion.

17. The archery bow of claim 14, defining a central vertical plane, a shape of the sling mount symmetrical across the central vertical plane.

18. An archery bow comprising:

a riser;

a first limb cup supporting a first limb assembly, the first limb assembly comprising a first limb member and a second limb member;

a second limb cup supporting a second limb assembly;

a bowstring; and a sling mount comprising a proximal portion, an intermediate portion and a distal portion, the proximal portion attached to the first limb cup, a width of the intermediate portion being less than a width of the distal portion;

the bow defining a central vertical plane, the central vertical plane bisecting the sling mount, a shape of the sling mount symmetrical across the central vertical plane.

19. The archery bow of claim 18, the sling mount comprising a first sling mount, the bow further comprising a second sling mount attached to the second limb cup.

20. The archery bow of claim 19, a shape of the second sling mount symmetrical across the central vertical plane.

* * * * *